US011583125B1

(12) United States Patent
Kachan et al.

(10) Patent No.: US 11,583,125 B1
(45) Date of Patent: Feb. 21, 2023

(54) DELIVERY GUARD

(71) Applicants: Justin Sion Kachan, Commerce, CA (US); Jason Goel Kachan, Commerce, CA (US); Amy Sue Affre, Long Beach, CA (US)

(72) Inventors: Justin Sion Kachan, Commerce, CA (US); Jason Goel Kachan, Commerce, CA (US); Amy Sue Affre, Long Beach, CA (US)

( * ) Notice: Subject to any disclaimer, the term of this patent is extended or adjusted under 35 U.S.C. 154(b) by 0 days.

(21) Appl. No.: 17/373,618

(22) Filed: Jul. 12, 2021

Related U.S. Application Data

(60) Provisional application No. 63/050,199, filed on Jul. 10, 2020.

(51) Int. Cl.

| | |
|---|---|
| ***A47G 29/22*** | (2006.01) |
| ***A47G 29/30*** | (2006.01) |
| ***A47G 29/124*** | (2006.01) |
| *A47G 29/14* | (2006.01) |

(52) U.S. Cl.
CPC ..... *A47G 29/22* (2013.01); *A47G 29/1251* (2017.08); *A47G 29/30* (2013.01); *A47G 29/141* (2013.01)

(58) Field of Classification Search
CPC ..... A47G 29/20; A47G 29/30; A47G 29/141; A47G 29/1248; A47G 29/1251; A47G 29/12095; A47G 29/22
USPC ..... 232/38, 45, 47, 48, 51
See application file for complete search history.

(56) References Cited

U.S. PATENT DOCUMENTS

| | | | | |
|---|---|---|---|---|
| 27,466 | A * | 3/1860 | North | A47G 29/12095 232/47 |
| 132,865 | A * | 11/1872 | Sinclaire | A47G 29/12095 43/67 |
| 442,983 | A * | 12/1890 | Kinsey | A47G 29/12095 232/48 |
| 445,497 | A * | 1/1891 | Catudal et al. | A47G 29/12095 232/47 |
| 1,136,050 | A * | 4/1915 | Razny | A47G 29/12095 232/47 |
| 5,435,484 | A * | 7/1995 | Carlson | A47G 29/1251 232/47 |
| 6,375,071 | B1 * | 4/2002 | Kim | A47G 29/12095 232/47 |
| 7,252,220 | B1 * | 8/2007 | Shreve | A47G 29/124 232/29 |

(Continued)

*Primary Examiner* — William L Miller
(74) *Attorney, Agent, or Firm* — Thomas I Horstemeyer, LLP

(57) ABSTRACT

Various examples are provided related to package delivery receptacles. In one example, a delivery guard includes a depository contained within a front surface, a rear surface, and side surfaces of the delivery guard; a front facing package drop door pivotally attached to the front surface; a package deposit shelf attached to the front facing package drop door at a fixed orientation; a second shelf pivotally attached to the rear surface; and a linkage assembly coupled between the package deposit shelf and the second shelf. Rotation of the front facing package drop door between open and closed positions simultaneously rotates the second shelf via the linkage assembly. The package deposit shelf and the second shelf can rotate downward as the front facing package drop door is closed thereby providing a sloped opening to the depository.

12 Claims, 4 Drawing Sheets

(56) References Cited

U.S. PATENT DOCUMENTS

| | | | | |
|---|---|---|---|---|
| 7,320,427 | B2 * | 1/2008 | Prestwich | A47G 29/22 232/51 |
| 7,946,472 | B2 * | 5/2011 | Bolles | A47G 29/22 232/51 |
| 8,960,530 | B2 * | 2/2015 | Silke | A47G 29/22 232/47 |
| 9,004,346 | B2 * | 4/2015 | Farentinos | A47G 29/22 232/43.3 |
| 11,033,136 | B2 * | 6/2021 | Kutas | A47G 29/16 |
| 11,253,094 | B1 * | 2/2022 | Deck | A47G 29/30 |
| 2008/0067227 | A1 * | 3/2008 | Poss | H02J 9/005 340/569 |
| 2009/0314828 | A1 * | 12/2009 | Hjorth | A47G 29/1251 232/44 |
| 2010/0127063 | A1 * | 5/2010 | Bolles | A47G 29/22 29/434 |
| 2018/0070753 | A1 * | 3/2018 | Eveloff | H04W 4/025 |
| 2021/0186246 | A1 * | 6/2021 | Luckey | A47G 29/141 |
| 2021/0321809 | A1 * | 10/2021 | Carlson | A47G 29/16 |

* cited by examiner

DELIVERY GUARD

CROSS REFERENCE TO RELATED APPLICATIONS

This application claims priority to, and the benefit of, U.S. provisional application entitled "Delivery Guard" having Ser. No. 63/050,199, filed Jul. 10, 2020, which is hereby incorporated by reference in its entirety.

BACKGROUND

With the increase in online ordering, safe and secure package delivery has become an increased problem for homeowners. This can be especially true where delivered packages can sit exposed for extended periods of time.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1B:
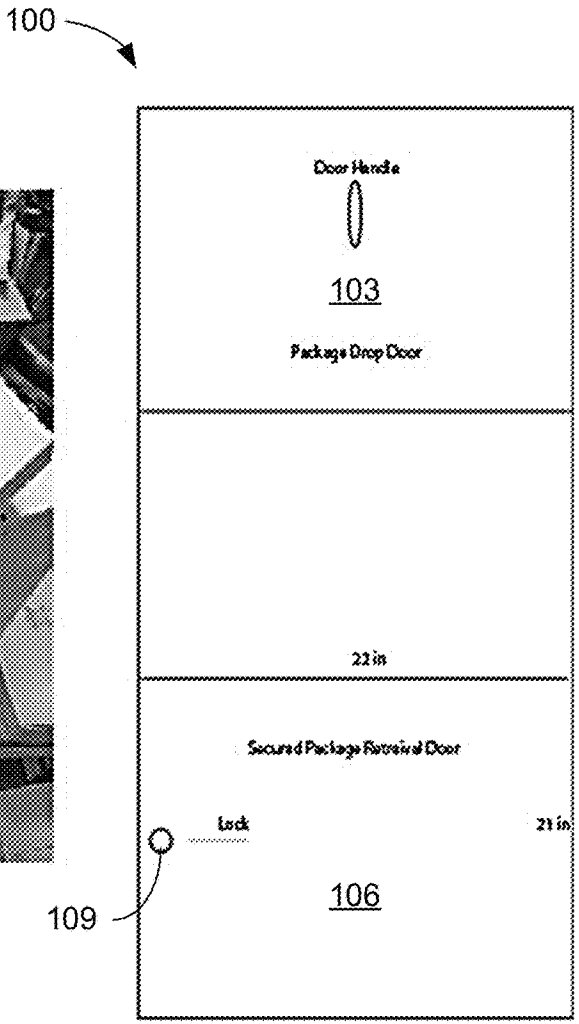
FIGS. 1A-1C illustrate an example of a delivery guard, in accordance with various embodiments of the present disclosure.
Figure 1C:
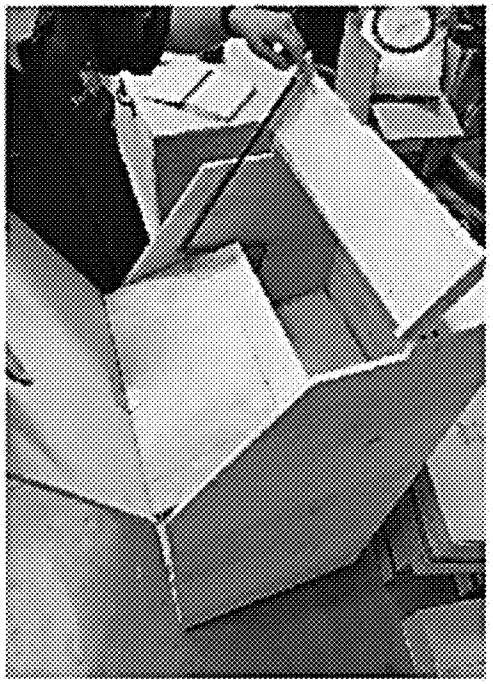

Disclosed herein are various examples related to package delivery receptacles. For example, a delivery guard is a receptacle configured to safely receive and securely store packages for later retrieval. The delivery guard can act as a deterrent to theft. The delivery guard is designed to protect deliveries from "Porch Pirates" who steal packages left at a front door. Reference will now be made in detail to the description of the embodiments as illustrated in the drawings, wherein like reference numbers indicate like parts throughout the several views.

The package receptacle can receive delivered packages safely at the front door of a home, office or delivery location. It can work with a large assortment of package sizes and can include a bonus door for odd-sized packages. A keyless number lock pad can be used for security. In addition, LED and/or UV lighting can be used to illuminate the inside of the receptacle for easy retrieval and can also kill germs on the outside of packages. The lighting can be provided continuously or can be controlled in response to opening and closing of a package drop door and/or a package retrieval door.

Figure 1A:
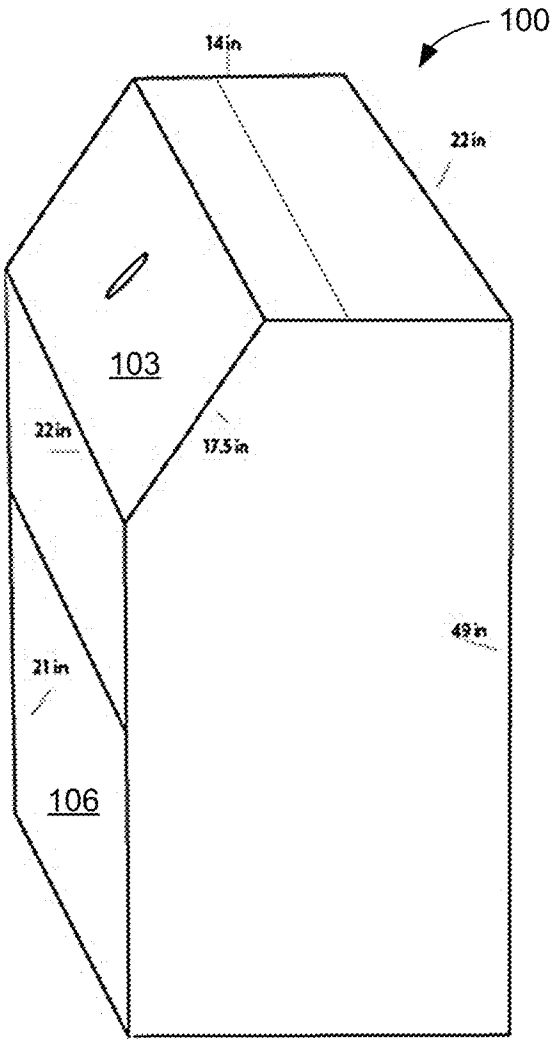

FIGS. 1A and 1B provide perspective and front views of an example of a delivery guard 100, including a package drop door 103 to deposit the package in the top of the delivery guard receptacle 100 and secured package retrieval door 106 to retrieve the package from the depository at the bottom of the delivery guard 100. The delivery guard 100 can be crafted from all-weather resin to withstand the elements but can utilize other appropriate materials in its construction. The package receptacle 100 can protect deliveries from the harsh elements of weather including rain, snow, wind, sun, etc. The design enables delivery companies to easily deposit deliveries in both soft and hard parcels and in a variety of sizes and shapes, while granting access to only authorized persons with the code to unlock the lock 109 of the retrieval door 106.

The top where packages are deposited can include, e.g., two doors as shown in FIG. 10, ensuring the widest variety of package sizes. The delivery guard 100 can be designed so limited or no bending of the package is needed for use. The delivery guard 100 can be sized to accommodate a wide range of packages. In the embodiment of FIGS. 1A and 1B, the delivery guard 100 stands 49 inches tall and is 22 inches wide. The front facing package drop door 103 is 17.5 inches and opens out at about a 60-degree angle. The delivery guard can be fabricated with other dimensions. Secured to the front facing package drop door 103 is a deposit shelf 112 (FIG. 2A) that allows the package to be deposited into the bottom of the delivery guard 100 as the package drop door 103 is closed. As shown in FIG. 10, the top package drop door can open upward about 120-degrees leaving an enlarged space to accommodate a variety of package sizes.

Figure 2B:
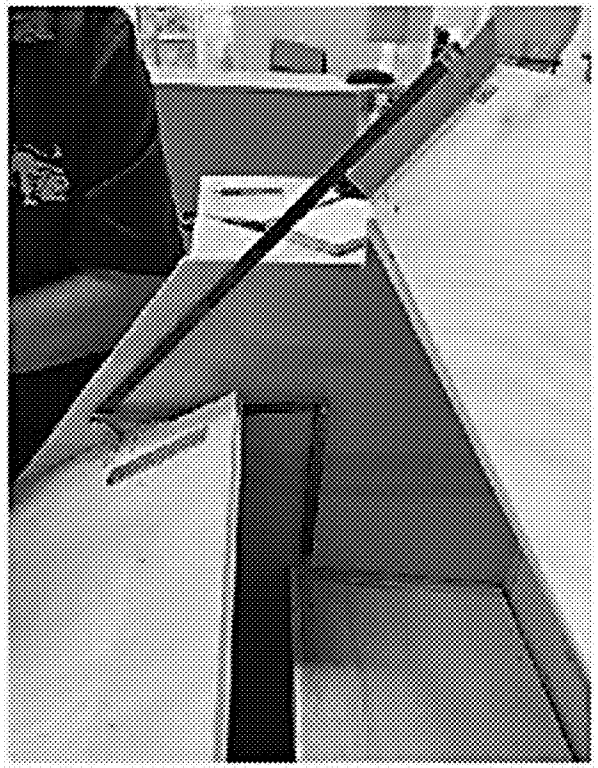
FIGS. 2A-2C illustrate an example of the internal configuration of the delivery guard of FIGS. 1A-1C, in accordance with various embodiments of the present disclosure.
Figure 2A:
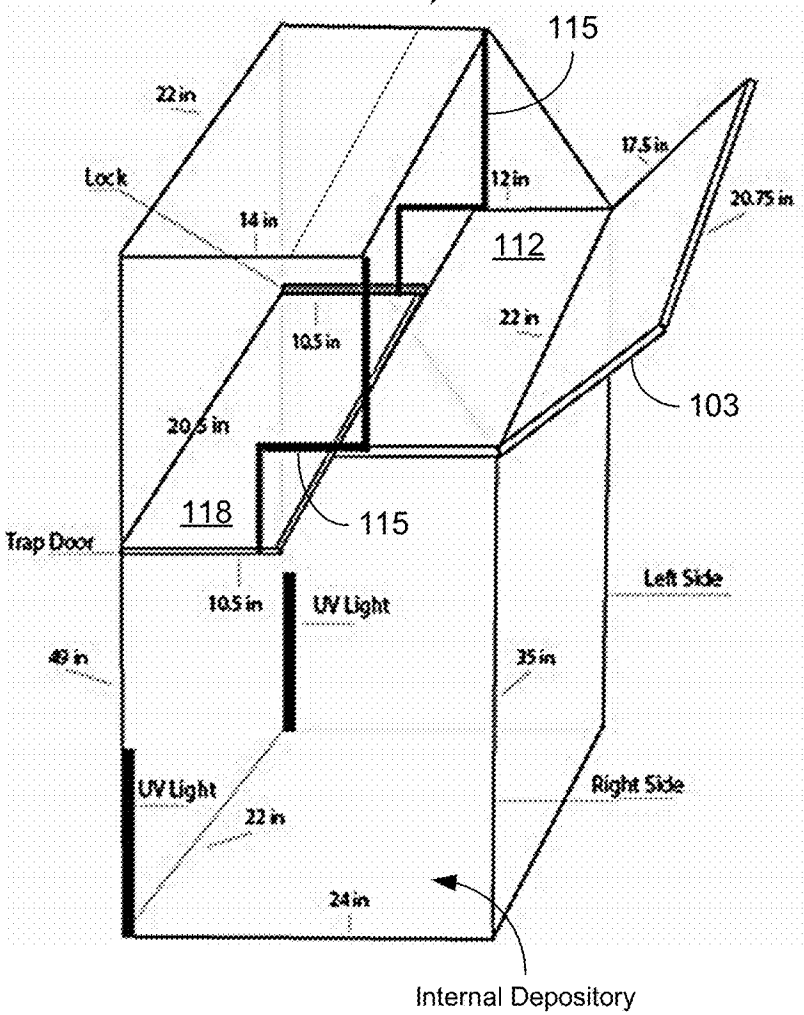

FIG. 2A illustrates an example of a mechanism for opening the front facing and top package drop doors and transferring the package to the depository at the bottom of the receptacle until retrieved. The mechanism can include a unique design of levers (or linkages) 115 that move in sync ensuring the items are safely deposited and prevent someone from reaching into the receptacle from the top. UV and/or LED lighting can be mounted in the depository to provide lighting and/or disinfection. As shown in the image of FIG. 2B, when the front facing package drop door 103 is opened the top package drop door is simultaneously opened from the top of the delivery guard 100, via the levers or linkages 115, while bringing the deposit shelf 112 up from the middle to a substantially horizontal position.

During delivery, the package gets placed inside the front facing package drop door 103 on the attached deposit shelf 112. When the front facing package drop door 103 is closed, the attached deposit shelf 112 angles down using gravity to drop the package to a second shelf 118 (FIG. 2A). As the front facing package drop door 103 is closed, the second shelf 118 is also pivoted via the levers or linkages 115. The second shelf 118 is now angled down and allows the package to drop gently to the depository at the bottom of the delivery guard 100. The depository can be secured by a combination lock "(no keys to lose, no electronics just a combination) or other appropriate locking mechanism. On the bottom of the depository, a ¼ inch thick sheet of memory foam can be included to help minimize the breakage and further protecting the delivery.

As shown in FIG. 2B, the levers or linkages 115 can include a central link, a door link pivotally connected to a first end of the central link, and a shelf link pivotally connected to a second end of the central link. A central link can be pivotally attached to one side (or central links pivotally attached to both sides) of the deposit shelf 112 that is attached to the front facing package drop door 103. The door link can be pivotally connected to the top package drop door 121 (FIG. 2C) at the end opposite the central link connection. The shelf link can be pivotally connected to the second shelf 118 at the end opposite the central link connection. The levers or linkages can be pivotally connected to the deposit shelf 112, the second self 118, and/or the top package drop door 121 by connector plates. As the front facing package drop door 103 is opened, the levers or linkages 115 causes the top package drop door 121 to fold open and the second shelf 118 to pivot upward to a substantially horizonal position as shown in FIG. 2B, thereby limiting access to the internal depository while the package drop doors are open.

Figure 2C:
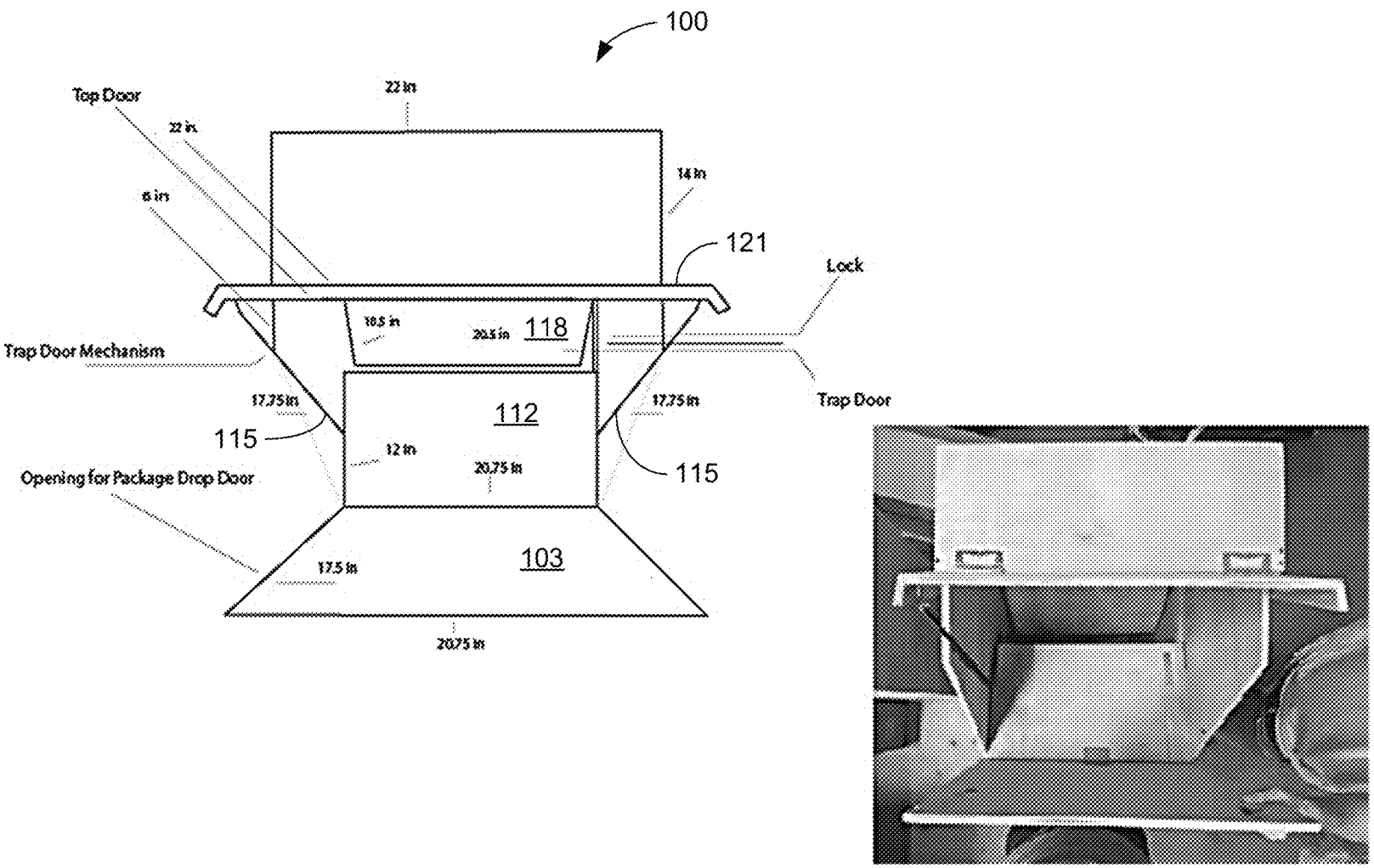

As the front facing package drop door 103 is closed, the levers or linkages 115 causes the top package drop door to close and the second shelf 118 to pivot downward to an angled position. FIG. 2C includes a top view of the delivery guard 100 with the front facing package drop door 103 partially closed. As can be seen in the image, the top package drop door 121 has pivoted to a substantially vertical position and the second shelf 118 within the delivery guard 100 has rotated to a downward angle. As the front facing package drop door 103 continues to close, the deposit shelf 112 rotates to a downward angle and a package on the deposit shelf 112 slides towards the second shelf 118 and drops into the depository for later retrieval.

Figure 3B:
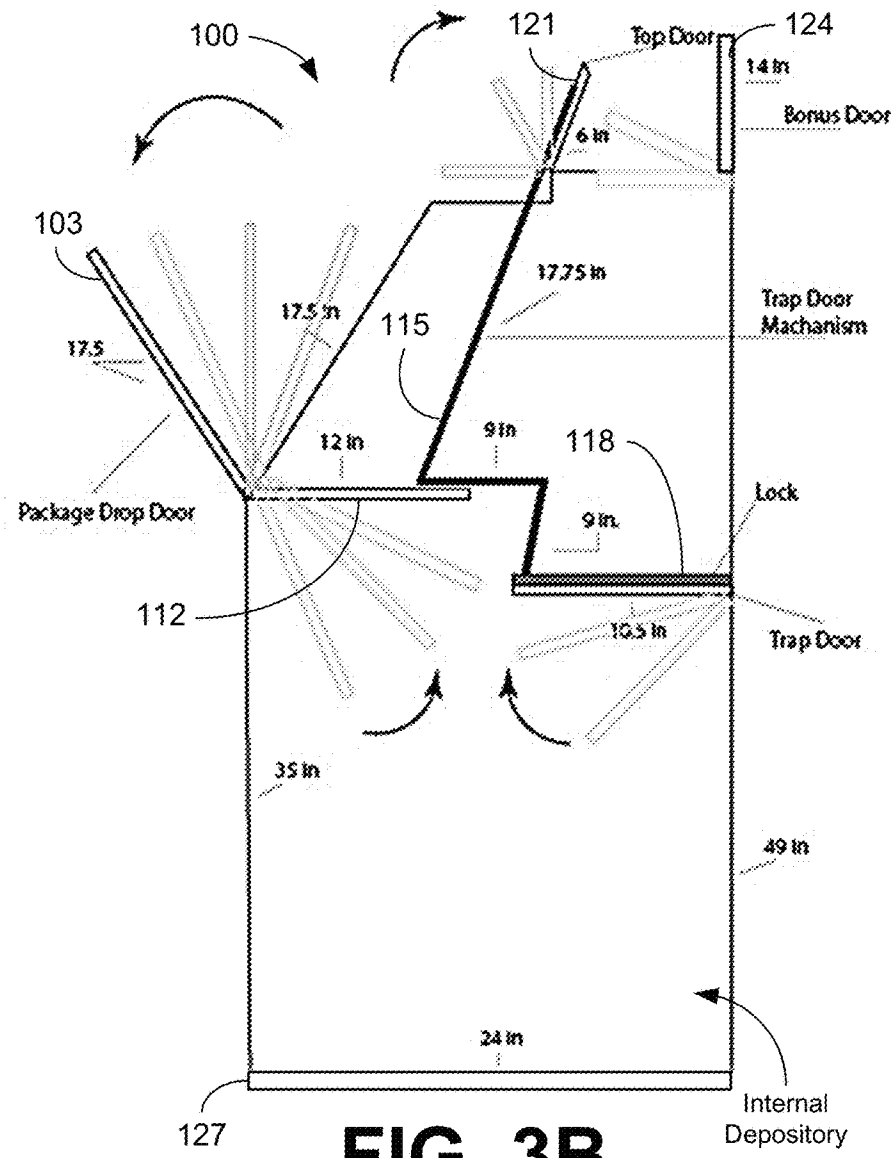
FIGS. 3A and 3B illustrate an example of the operation of the delivery guard of FIGS. 1A-1C and 2A-2C, in accordance with various embodiments of the present disclosure.
Figure 3A:
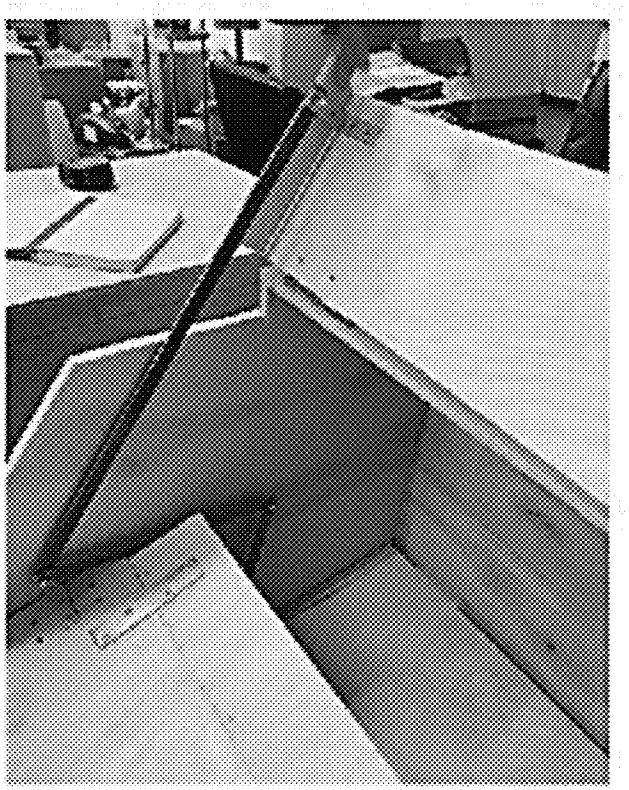

The relationships between the front facing package drop door 103, top package drop door 121, deposit shelf 112 and second shelf 118 are illustrated in FIGS. 3A and 3B. FIG. 3A is an image showing the package drop doors fully open. As illustrated in FIG. 3B, as the front facing package drop door 103 is opened (e.g., by a rotation of about 60-degrees), the deposit shelf 112 pivots upward (e.g., about 60-degrees) to a substantially horizontal position. The levers or linkages 115 cause the top package drop door 121 to simultaneously pivot open (e.g., by a rotation of about 120-degrees) to provide additional clearance to deposit a package on the deposit shelf 112. The levers or linkages 115 also cause the second shelf 118 to pivot upward to a substantially horizontal position.

As the front facing package drop door 103 is returned to its closed position, the top package drop door 121 is also closed by the levers or linkages 115, and the deposit shelf 112 and second shelf 118 rotate downward allowing the package to drop into the internal depository of the delivery guard 100. The delivery guard 100 can also include a bonus door 124 in the top surface to allow odd-sized packages (e.g., longer than the width of the package drop doors) to be inserted directly into the internal depository between the shelves 112 and 118. The height of the delivery guard 100 can prevent an individual from reaching into the depository to grasp a package.

A hollow bottom compartment 127 at the bottom of the delivery guard 100 (e.g., measuring about 2 inches in depth) can allow for the filling of sand or gravel to weight the delivery guard 100 securely to the porch. This serves two purposes: (1) to keep the delivery guard 100 from tipping in severe weather and (2) to provide an excellent deterrent to theft of the delivery guard 100. In some implementations, bolts can be used to allow the end user to bolt the delivery guard 100 to a permanent structure or allow the delivery guard 100 to stand freely.

In some embodiments, a hidden top back door opens out at about a 180-degree angle allowing odd-sized packages (e.g., tubes or other elongated packages) to be placed in the depository at the bottom of the delivery guard 100. Delivery Guard can be shipped to the end user flat (in a knocked down condition) for assembly. All tools and instructions can be included.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

The term "substantially" is meant to permit deviations from the descriptive term that don't negatively impact the intended purpose. Descriptive terms are implicitly understood to be modified by the word substantially, even if the term is not explicitly modified by the word substantially.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. A delivery guard, comprising:
- a depository contained within a front surface, a rear surface, and side surfaces of the delivery guard;
- a front facing package drop door pivotally attached to the front surface;
- a package deposit shelf attached to the front facing package drop door at a fixed orientation;
- a second shelf pivotally attached to the rear surface; and
- a linkage assembly coupled between the package deposit shelf and the second shelf, where rotation of the front facing package drop door between open and closed positions simultaneously rotates the second shelf via the linkage assembly, and the package deposit shelf and the second shelf rotate downward as the front facing package drop door is closed thereby providing a sloped opening to the depository.

2. The delivery guard of claim 1, comprising a top package drop door pivotally attached to a top surface of the delivery guard, the linkage assembly coupled to the top package drop door, where the rotation of front facing package drop door between the open and closed positions simultaneously rotates the top package drop door.

3. The delivery guard of claim 2, wherein the linkage assembly comprises:
- a central link pivotally attached to the package deposit shelf;
- a door link pivotally connected to a first end of the central link and the top package drop door; and
- a shelf link pivotally connected to a second end of the central link and the second shelf.

4. The delivery guard of claim 1, comprising a package retrieval door configured to provide secured access to the depository.

5. The delivery guard of claim 4, comprising a lock to secure the package retrieval door.

6. The delivery guard of claim 4, wherein the package retrieval door is located in the front surface of the delivery guard.

7. The delivery guard of claim 4, wherein the package retrieval door is located in the rear surface or one of the side surfaces of the delivery guard.

8. The delivery guard of claim 1, comprising UV lighting within the depository.

9. The delivery guard of claim 8, wherein the UV lighting is configured to illuminate the depository in response to closing of the front facing package drop door.

10. The delivery guard of claim 9, wherein the UV lighting illuminates the depository for a predefined period of time.

11. The delivery guard of claim 1, comprising LED lighting within the depository.

12. The delivery guard of claim 11, wherein the LED lighting is configured to illuminate the depository in response to opening of a package retrieval door.

* * * * *